US008839982B1

(12) United States Patent
Anderson et al.

(10) Patent No.: US 8,839,982 B1
(45) Date of Patent: Sep. 23, 2014

(54) DISPENSING CAPSULE WITH DUAL INDEPENDENT DISPENSING CHAMBERS

(76) Inventors: Michael R. Anderson, Deerfield Beach, FL (US); Lillemor I. Anderson, Arroyo Grande, CA (US)

( * ) Notice: Subject to any disclaimer, the term of this patent is extended or adjusted under 35 U.S.C. 154(b) by 0 days.

(21) Appl. No.: 13/480,958

(22) Filed: May 25, 2012

Related U.S. Application Data

(60) Provisional application No. 61/490,920, filed on May 27, 2011.

(51) Int. Cl.

| | |
|---|---|
| ***B65D 85/72*** | (2006.01) |
| ***B65D 17/30*** | (2006.01) |
| ***B65D 17/42*** | (2006.01) |
| ***B65D 51/22*** | (2006.01) |
| ***B65D 25/08*** | (2006.01) |

(52) U.S. Cl.
USPC ..... 220/521; 220/267; 220/277; 220/258.4; 206/222; 215/DIG. 8; 215/227

(58) Field of Classification Search
USPC ..... 220/521, 267, 277, 287, 258.4; 206/222; 215/DIG. 8, 227
See application file for complete search history.

(56) References Cited

U.S. PATENT DOCUMENTS

| | | | | |
|---|---|---|---|---|
| 5,979,647 | A * | 11/1999 | Han | 206/222 |
| 6,305,576 | B1 * | 10/2001 | Leoncavallo | 222/83.5 |
| 2010/0044377 | A1 * | 2/2010 | Porter | 220/212 |
| 2012/0168326 | A1 * | 7/2012 | Pannu | 206/219 |

* cited by examiner

*Primary Examiner* — Fenn Mathew
*Assistant Examiner* — Jennifer Castriotta
(74) *Attorney, Agent, or Firm* — Malin Haley DiMaggio & Bowen, P.A.

(57) ABSTRACT

A dispensing capsule, comprising a cap body including a chamber, whereby the bottom of the chamber is sealed by a sealing member. The cap body includes one or more plungers, each plunger received in a sub-chamber of the chamber, and one or more flexible actuators engaged to the one or more plungers, whereby the actuators are accessible at a top portion of the cap body. The flexible actuators may comprise a bellow-type blast or stepped blast. In some embodiments, a dust cover is provided to cover said top portion of the cap body. By applying pressure to the one or more actuators, the one or more plungers displace downward and break at least a portion of the sealing member. This allows for independent dispensing of an ingredient stored in each of the sub-chambers.

8 Claims, 18 Drawing Sheets

DISPENSING CAPSULE WITH DUAL INDEPENDENT DISPENSING CHAMBERS

CROSS REFERENCE TO RELATED APPLICATIONS

This application claims priority to U.S. Provisional Application Ser. No. 61/490,920 filed on May 27, 2011.

STATEMENT REGARDING FEDERALLY SPONSORED RESEARCH OR DEVELOPMENT

N/A

BACKGROUND OF THE INVENTION

1. Field of the Invention

The present invention generally relates generally to dispenser capsules for various ingredients and more particularly to a dual chambered dispensing capsule for use on a variety of containers.

2. Description of Related Art

Most if not all liquids, creams, gels and even certain powders and other substances are formulated and created for the longest shelf life and not necessarily for optimal performance and/or usefulness. There are many ingredients and/or combinations of ingredients that have reduced shelf life due to requiring combinations of liquid substances. In most all cases when any ingredients are exposed to one another, including air, deterioration begins and the clock on the limited shelf life starts. Also in most products in any category, "Shelf Life" is the key factor with respect expiration dates based on the product and category.

Several attempts have been made to design capsules and containers to improve the shelf life of compositions such as gels, liquids, powders and the like however the majority of the available device rely on a plurality of interconnected parts which are not cost effect to manufacture and assemble. The present invention is designed to be inexpensive to mass produce, fill and seal to be able to deliver an affordable dispensing capsule in virtually any application and category. This invention can be made from a one piece mold or more pieces depending on the desired application with features and benefits for keeping ingredients separate and fresh until time of use. This invention allows formulas and new products in any categories to be invented and made for desired end effects and not for what has to be done do to normal packaging and manufacturing and eliminating many unhealthy ingredients that are currently and normally used to produce most products. The present invention, therefore, is useful for packaging ingredients such as enzymes, calcium and magnesium with bio flavinoids vitamin C, probiotics creatine and many more. Moreover, the present invention allows for the mixing of a plurality of ingredients by providing a multi-chambered dispenser configuration. This provides a substantial improvement over the prior art with respect to shelf life and overall versatility.

It is, therefore, to the effective resolution of the aforementioned problems and shortcomings of the prior art that the present invention is directed. However, in view of the container capsules and related devices in existence at the time of the present invention, it was not obvious to those persons of ordinary skill in the pertinent art as to how the identified needs could be fulfilled in an advantageous manner.

SUMMARY OF THE INVENTION

The present invention provides a dispensing capsule, comprising a cap body including a chamber, whereby the bottom of the chamber is sealed by a sealing member. The cap body includes one or more plungers, each plunger received in a sub-chamber of the chamber, and one or more flexible actuators engaged to the one or more plungers, whereby the actuators are accessible at a top portion of the cap body. The flexible actuators may comprise a bellow-type blast or stepped blast. In some embodiments, a dust cover is provided to cover said top portion of the cap body. By applying pressure to the one or more actuators, the one or more plungers displace downward and break at least a portion of the sealing member. This allows for independent dispensing of an ingredient stored in each of the sub-chambers.

The cap body is adapted to be received on a container such as a bottle, IV bag, or the like. In some embodiments, the cap body includes internal threads such that the cap body is threadingly engaged with the container. The sealing member covering the bottom of the primary chambers includes at least one line of weakening to allow for independent breaking and dispensing of ingredients from the sub-chambers. The sealing member may comprise foil, plastic, or the like. The plungers may include an angle-cut distal tip adapted to break at least a portion of the sealing member.

In some embodiments, a rigid actuator tab is engaged with each of the flexible actuators to provide a more rigid means of actuating the device. Further, in some embodiments, the capy body includes a dispensing spout for accessing the contents of the container once the ingredients have been dispensed. A drink-through chamber comprising a portion of the primary chamber may be provided wherein the drink-through chamber is in flow communication with the dispensing spout.

In an alternative embodiment, the plungers are provided in a circumferential fashion and delimit a central channel therebetween, which central channel is configured to receive an applicator accessory such as a straw or sprayer accessory.

Accordingly, it is an object of the invention to provide a dispensing capsule for use with a primary container in which the dispensing capsule has two or more independently sealed and activated dispensing chambers each of which can contain a different substance to be dispensed into the primary container.

In accordance with these and other objects which will become apparent hereinafter, the instant invention will now be described with particular reference to the accompanying drawings.

DETAILED DESCRIPTION

Figure 1:
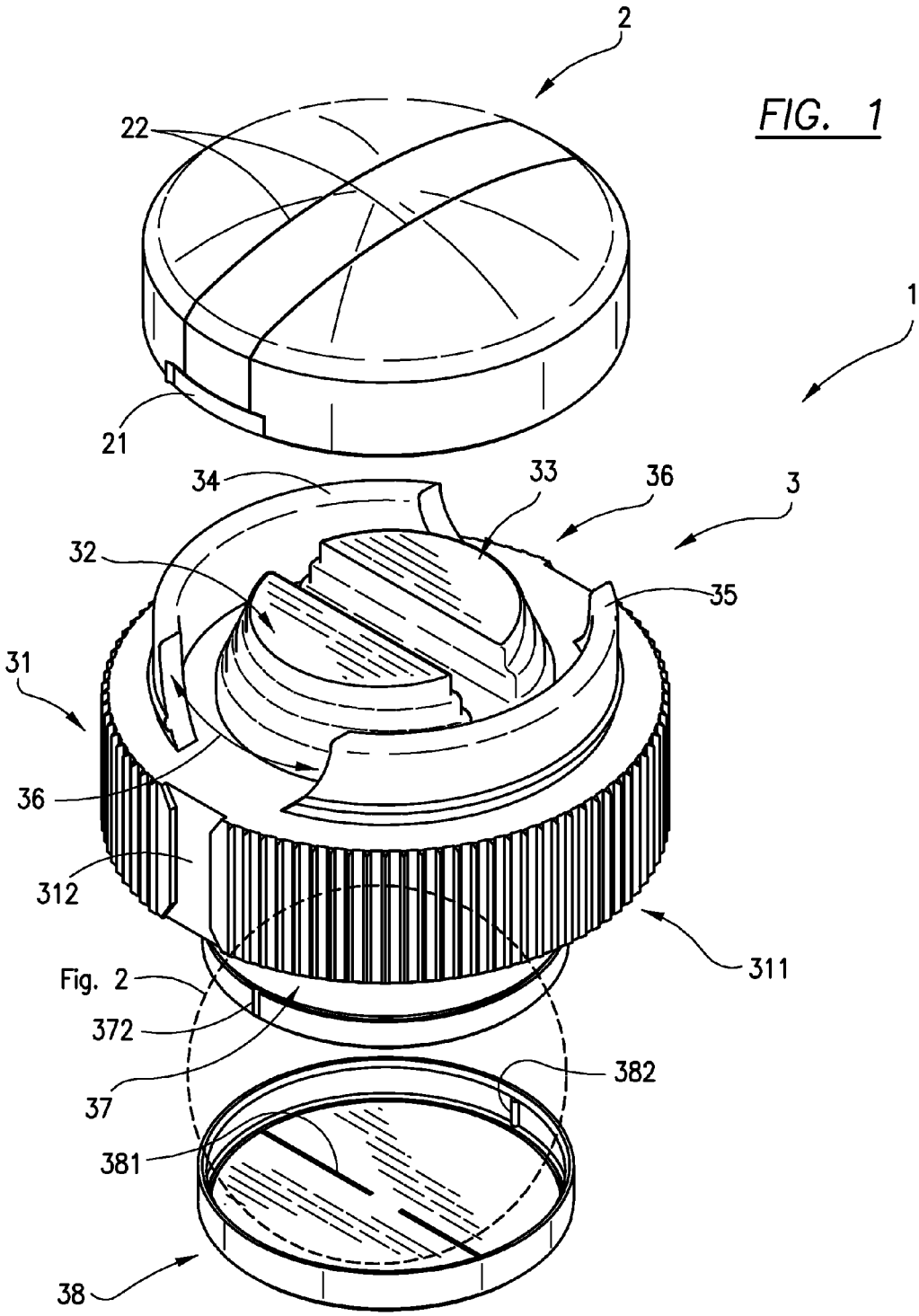
FIG. 1 is an exploded view of one embodiment of the dispensing capsule of the present invention.

FIG. 1 is a front perspective view of one aspect of the dispensing capsule of the present invention in an exploded view. The dispensing capsule 1 comprises a dust cover 2 and a cap body 3. Dust cover 2 includes a pull tab 21 and at least one line or strip of weakening 22 which is configured to be manually removed in order to remove the dust cover from the capsule 1. In some embodiments, the cap body 3 is generally cylindrical and includes an outer race 31 defining an outer gripping surface which race has internal threads 311 which are adapted to be received on a container as described further below. The top of cap body 3 includes two flexible actuators 32 and 33 which function as actuators for the capsule 1 of the present invention. The flexible actuators 32 and 33 may comprise flexible bellows or stepped blasts as shown and may be configured to seal to the top of the chambers of the cap body, which chambers are described in more detail below. The flexible actuators 32 and 33 are surrounded at least partially by two elevated rims 34 and 35. One or more gaps 36 may be located between the two rims 34 and 35 to provide a space for the user's fingers or other implement to access the actuators 32 and 33.

Figure 2:
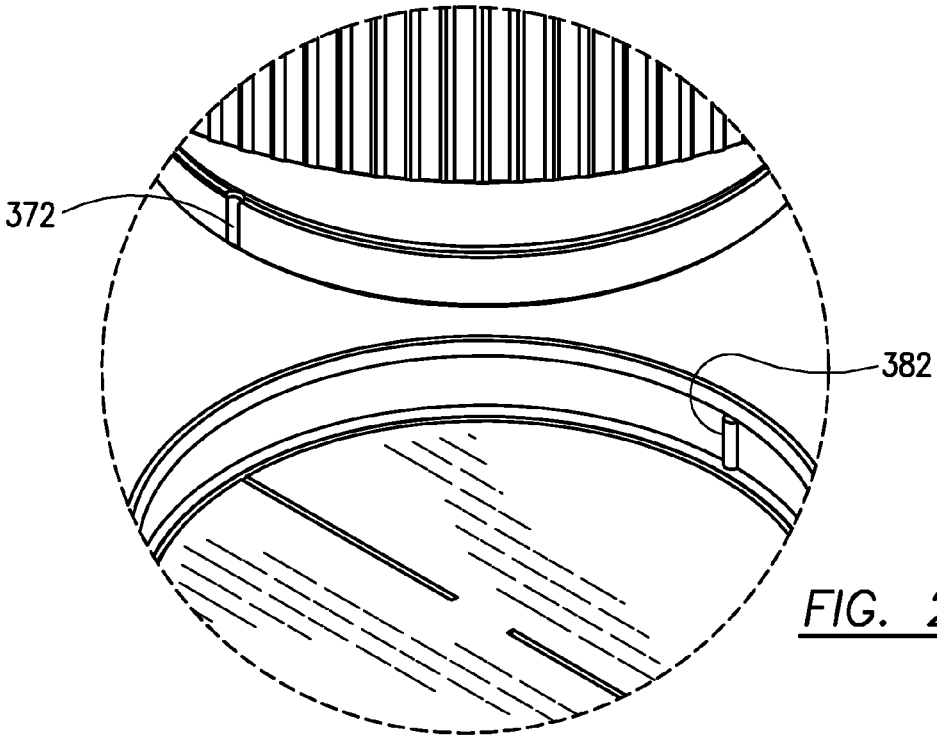
FIG. 2 is an up-close view of one the seal of one embodiment of the dispensing capsule of the present invention.
Figure 3:
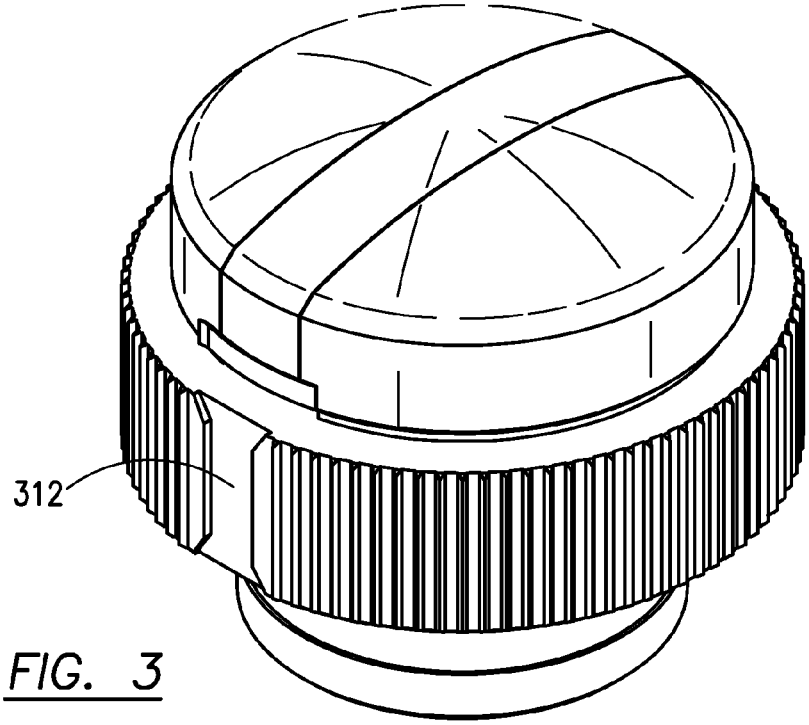
FIG. 3 is an up-close view of one embodiment of the dispensing capsule of the present invention with the dust cover closed demonstrating a centering area on the cap body.

The cap body includes a chamber 37 which extends concentrically below the outer race 31. Closing the bottom of the chamber 37 of cap body 3 is a seal member 38 which may include one or more lines of weakening 381. The seal member 38 may further include a centering protrusion 382 which corresponds to a centering notch 372 on the bottom portion of chamber 37. The centering notch 372 and the centering protrusion 382 are shown in more detail in FIG. 2. In some embodiments, the seal member 38 comprises a plastic or foil material that is breakable as described in more detail below. The outer race 31 may further comprise one or more centering areas 312 which are useful for centering the device in filling machines and also help to center the cover 2 and seal member 30 to the cap body such that all of the components are aligned. The centering area 312 is shown in more detail in FIG. 3.

Figure 4:
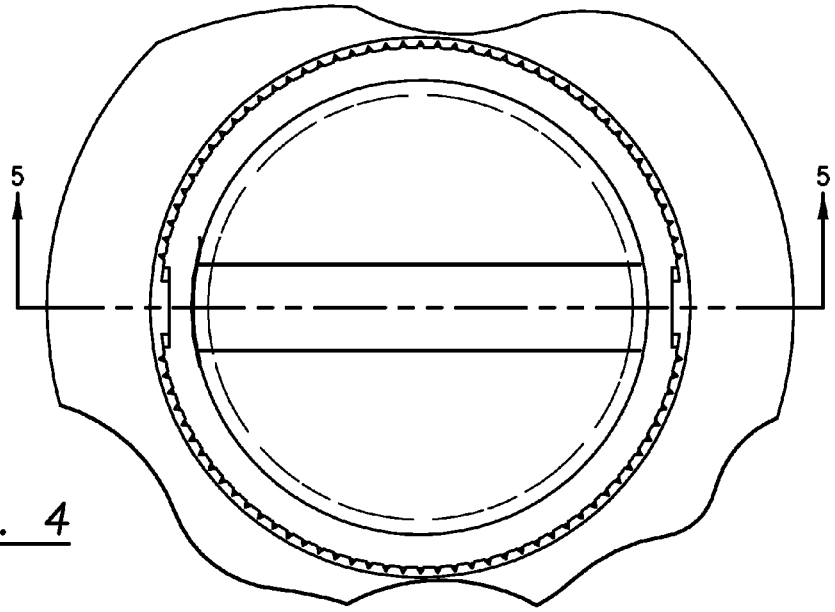
FIG. 4 is a top view of one embodiment of the dispensing capsule of the present invention as shown in FIG. 1.
Figure 5:
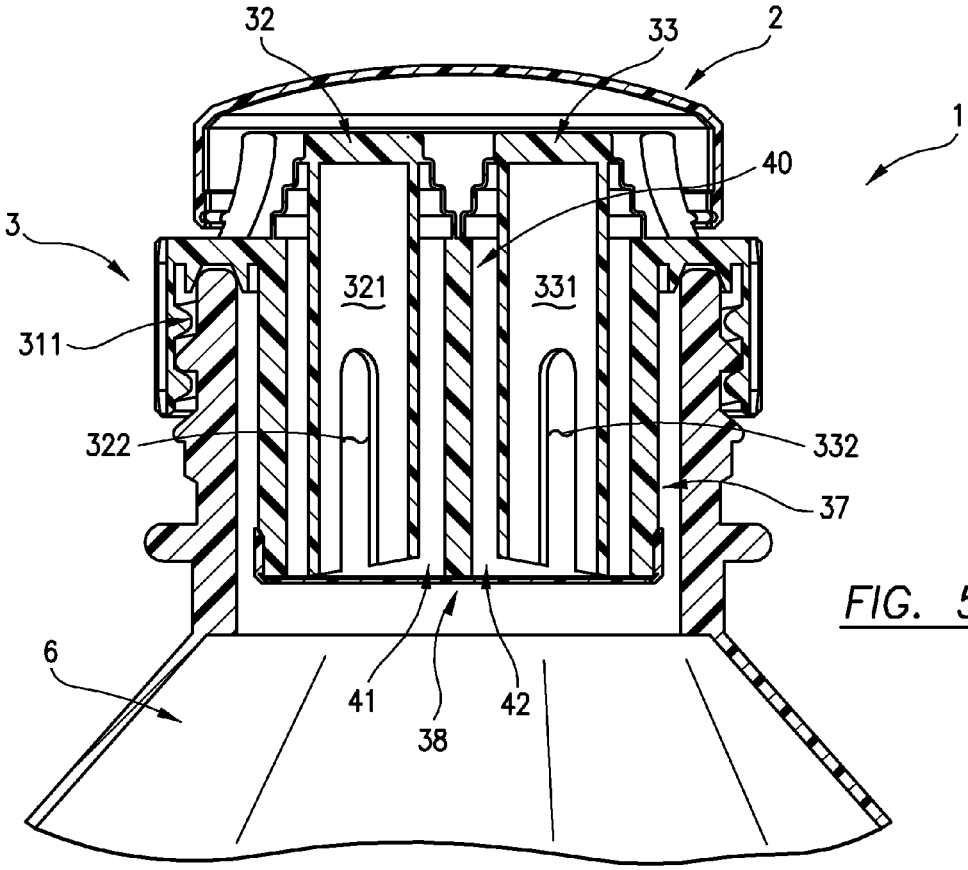
FIG. 5 is a section view of one embodiment of the dispensing capsule of the present invention as shown in FIG. 1

With reference to FIGS. 4-5, shown is a sectional view of the capsule 1 of the present invention taken along a mid-line 5-5 of the capsule 1. As shown, capsule 1 is received on a container 6 such that the threads 311 of cap body 3 are engaged with the corresponding threads 611 on container 6. In some embodiments, the threaded engagement may be substituted for a snap-fit or other suitable means for engaging the capsule 1 to the container 6. The flexible actuators 32 and 33 are each engaged with a corresponding plunger 321 and 331, respectively. In some embodiments, the plungers 321 and 331 are at least partially hollow and have cut-outs 322 and 332 respectively. The chamber 37 is bi-furcated by divider 40 which, in some embodiments, extends from the top to the bottom of the chamber 37. Accordingly, chamber 37 is divided into two sub-chambers 41 and 42 each of which may contain an ingredient to be dispensed.

Figure 6:
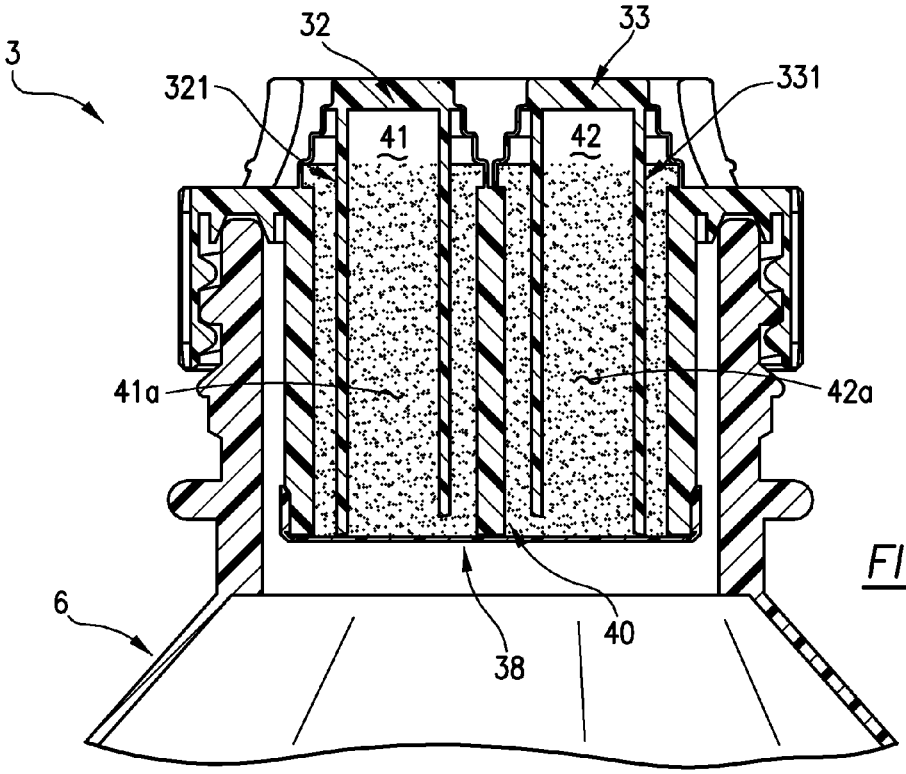
FIG. 6 is another section view of one embodiment of the dispensing capsule of the present invention shown in FIG. 1.
Figure 7:
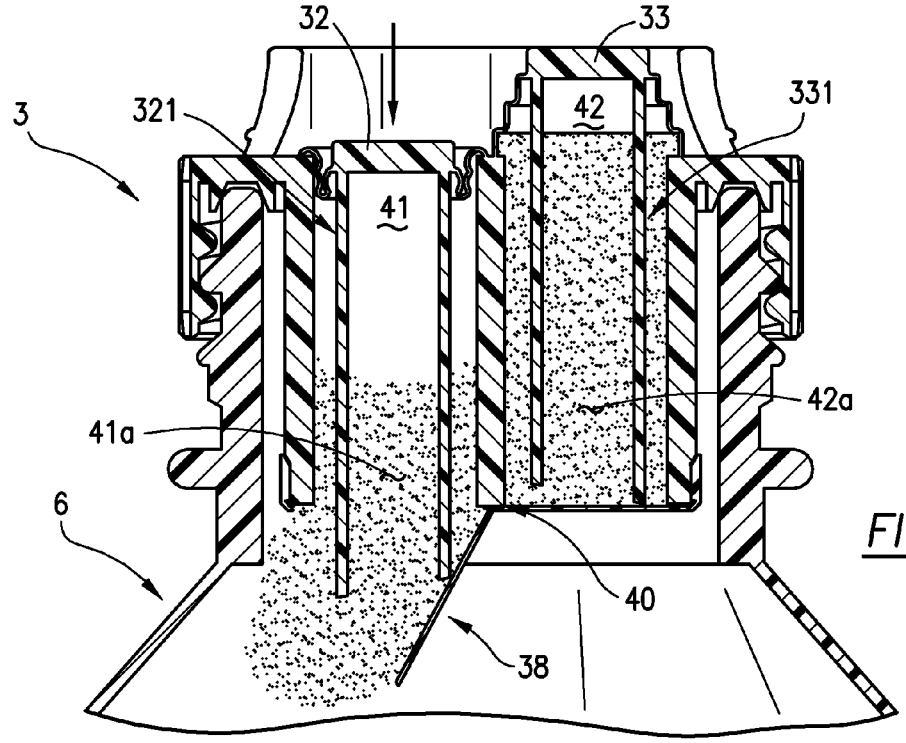
FIG. 7 is a yet is another section view of one embodiment of the dispensing capsule of the present invention shown in FIG. 1.

With reference to FIGS. 6-7, shown is an embodiment of the capsule 1 of the present invention in a filled and dispensing state. Sub-chamber 41 is filled with a first ingredient 41*a* and sub-chamber 42 is filled with a second ingredient 42*a*. The user activates the capsule by applying pressure to flexible actuators 32 and 33 as desired. In this case, as shown in FIG. 7, actuator 32 is selectively activated. As a result of downward force on actuator 32, plunger 321 which is engaged with actuator 32, displaces downward until the distal end of the plunger breaks at least a portion of seal 38. In some embodiments, the distal end of plunger 321 is angle-cut in order to provide a relatively sharp cutting or piercing edge which is suitable for breaking at least a portion of seal 38. Once at least a portion of seal 38 is broken, the first ingredient 41*a* will dispense from sub-chamber 41 into container 6. As mentioned previously, seal 38 may be separated by one or more lines of weakening such that a portion of the seal 38 will remain intact. For example, in FIG. 7, the portion of seal 38 covering sub-chamber 42 remains intact even though the portion covering sub-chamber 41 is broken by plunger 321. As a result of this configuration, the user can selectively and independently dispense the first and second ingredients 41*a* and 42*a* from the sub-chambers 41 and 42 on demand as desired.

Figure 8:
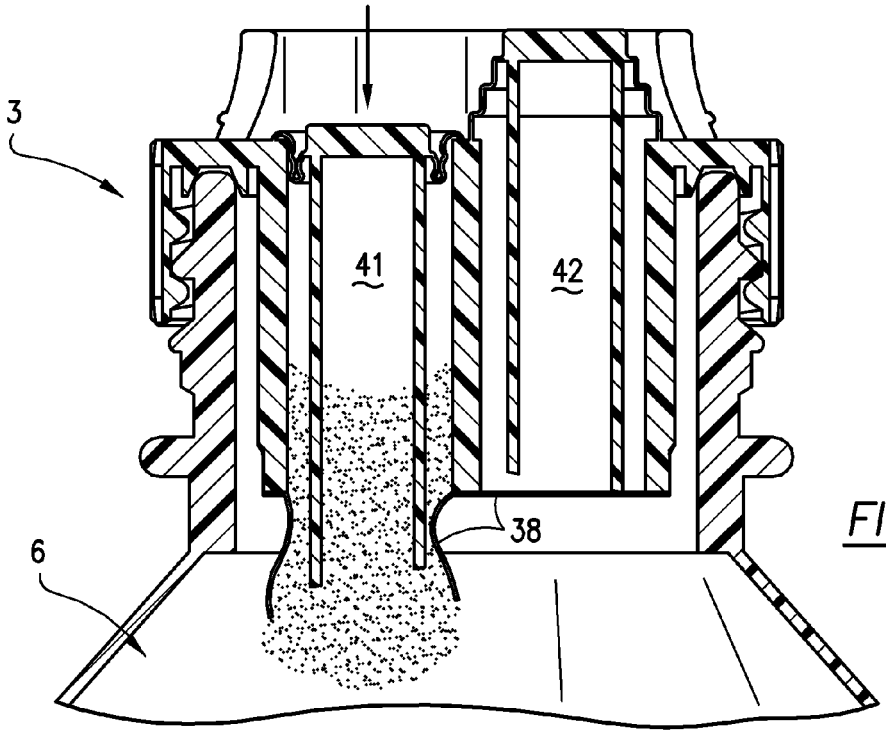
FIG. 8 is another section view of one embodiment of the dispensing capsule of the present invention shown in FIG. 1 in an activated state.

With reference to FIG. 8, the sealing member 38 may comprise foil seals 80 which cover the respective bottom portions of the sub-chambers 41 and 42. In this scenario, each of the foil seals will break independently of one another by way of the angle-cut plungers 321 and 331.

Figure 9:
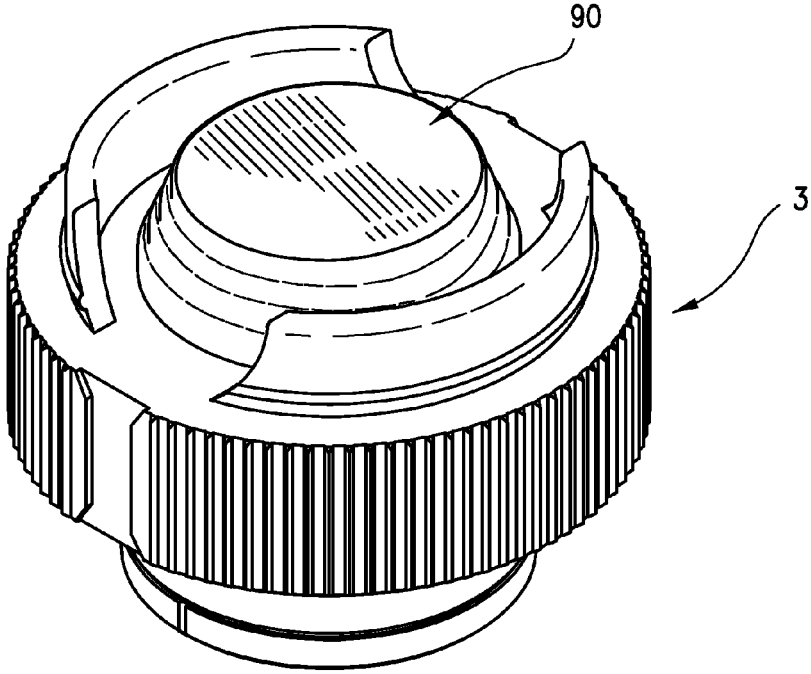
FIG. 9 is a perspective view of one embodiment of the dispensing capsule of the present invention.

With reference to FIG. 9, an alternative embodiment of the flexible actuators is shown. In this embodiment, the two actuators 32 and 33 may be substitute for a single flexible actuator 90 which can be configured to allow for independent dispensing of the two sub-chambers 41 and 42 by apply force on either side of the actuator 90. In an alternative embodiment, both sub-chambers 41 and 42 can be dispensed simultaneously by apply force to a central portion of the actuator 90. The actuator 90, in some embodiments, comprises a bellow-type or stepped flexible blast.

Figure 10:
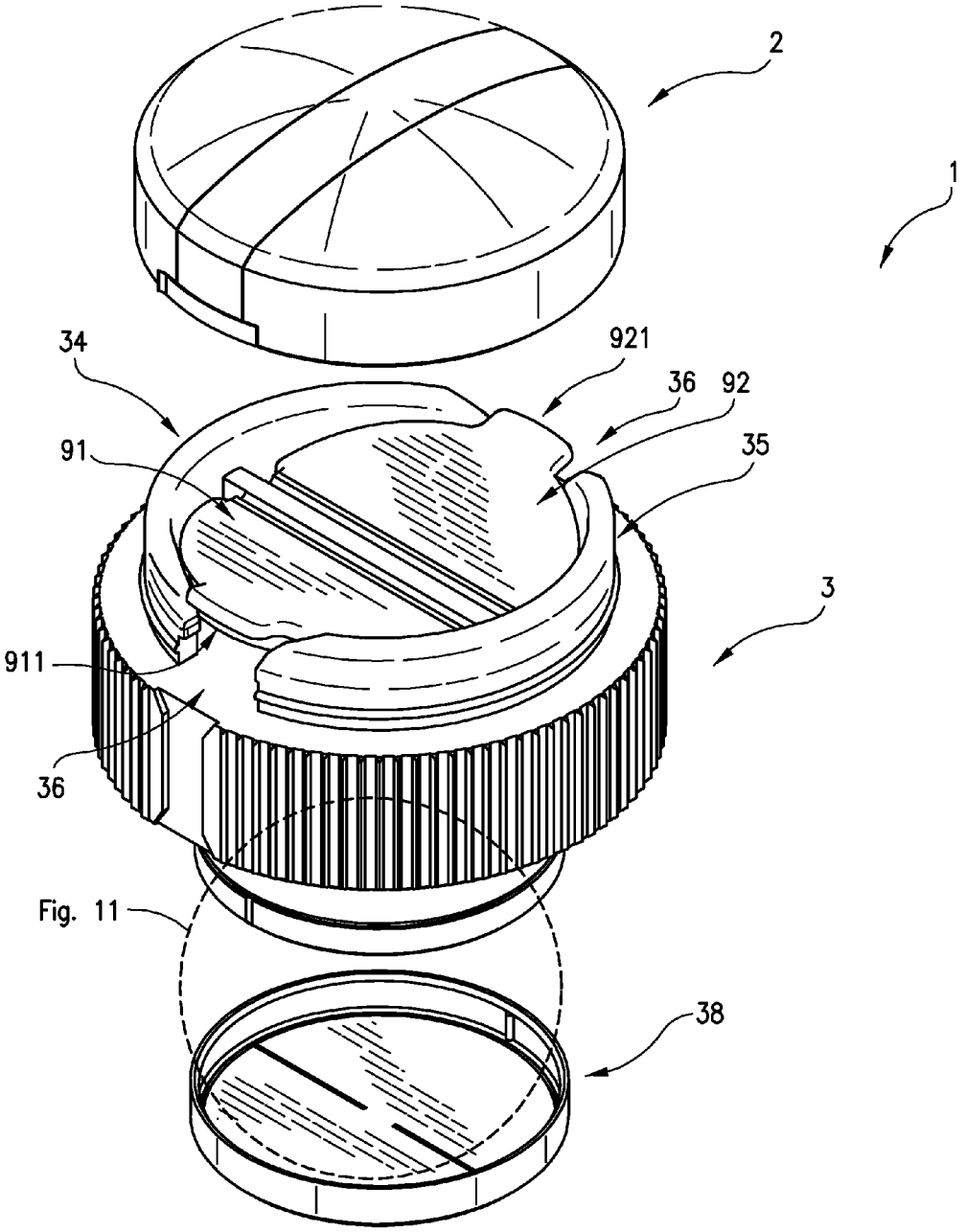
FIG. 10 is an exploded view of another embodiment of the dispensing capsule of the present invention.

With reference to FIG. 10, shown is an alternative embodiment of the capsule 1 of the present invention. Shown is dust cover 2, cap body 3, and sealing member 38. Here, the flexible actuators 32 and 33 are engaged with actuator tabs 91 and 92 which, in some embodiments, are substantially rigid. The tabs 91 and 92 are configured to be disposed between the rims 34 and 35 and include projections 911 and 921 which extend into gaps 36 between the two rims, allowing for easy access by hand.

Figure 11:
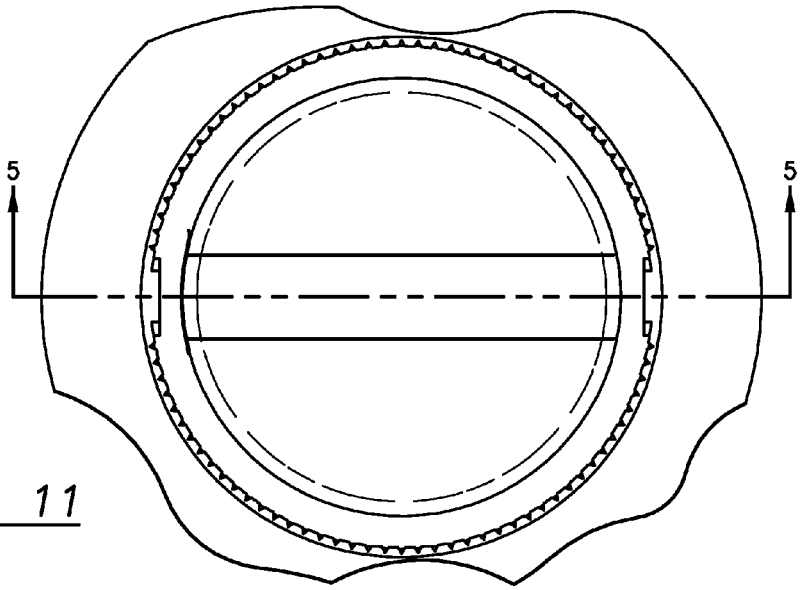
FIG. 11 is a top view of one embodiment of the dispensing capsule of the present invention shown in FIG. 10.
Figure 12:
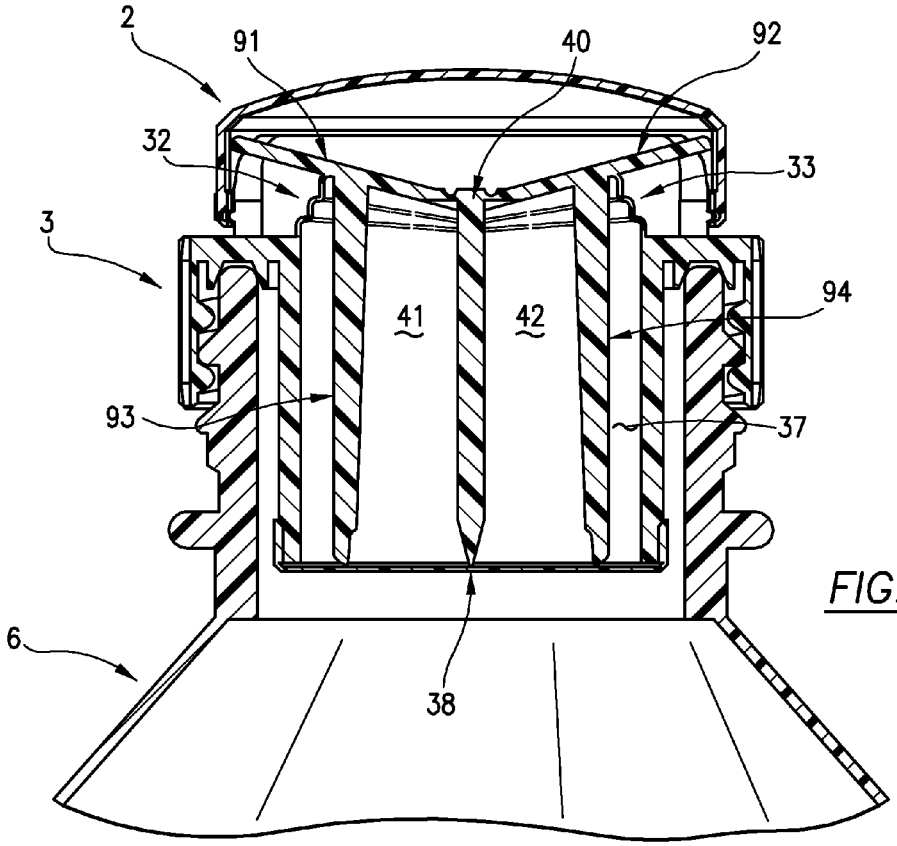
FIG. 12 is a section view of one embodiment of the dispensing capsule of the present invention shown in FIG. 10.

With reference to FIGS. 11 and 12, shown is a sectional view of the embodiment shown in FIG. 10. In this embodiment, actuator tabs 91 and 92 are coextensive with plungers 93 and 94 which define T-shaped plungers, whereby the flexible actuators 32 and 33 and disposed between the tabs and the top of the chamber 37. As shown, actuator tabs 91 and 92 are pivotably mounted to divider 40 which divider bifurcates chamber 37. The plungers 93 and 94 extend downward from their actuators into sub-chambers 41 and 42, respectively.

Figure 13:
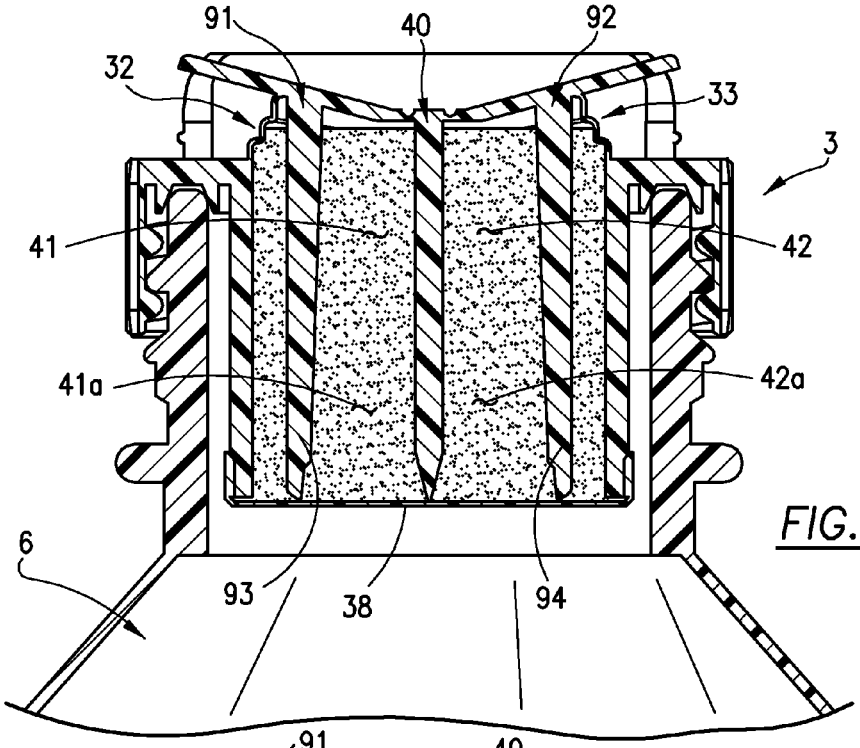
FIG. 13 is another section view of one embodiment of the dispensing capsule of the present invention shown in FIG. 10.
Figure 14:
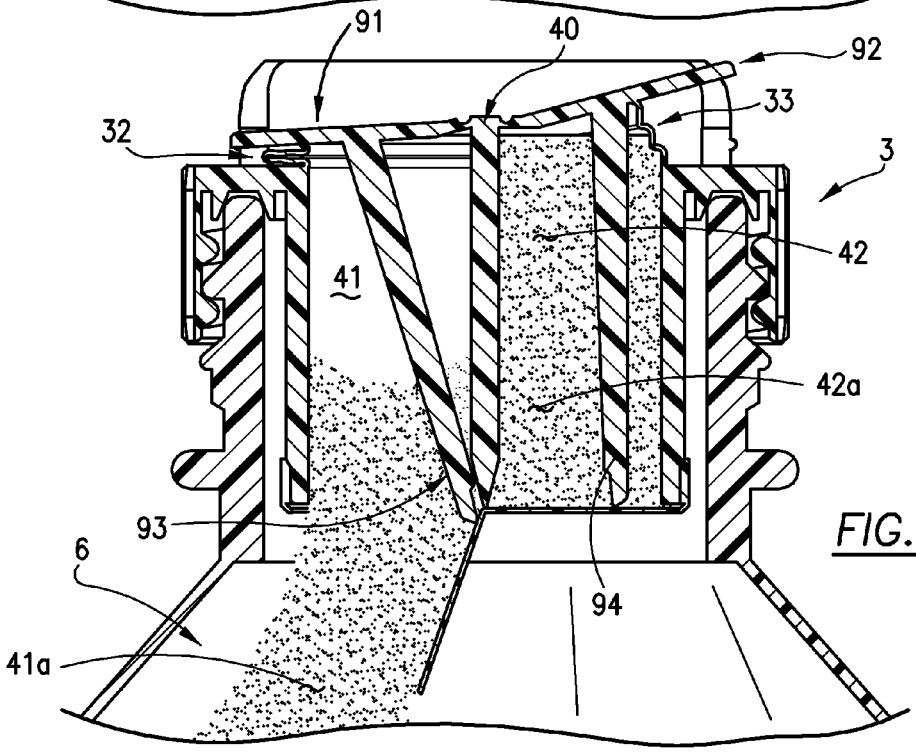
FIG. 14 is yet another section view of one embodiment of the dispensing capsule of the present invention shown in FIG. 10.

With respect to FIGS. 13 and 14, shown is an embodiment of the capsule 1 of the present invention in a filled and dispensing state. Sub-chamber 41 is filled with a first ingredient 41*a* and sub-chamber 42 is filled with a second ingredient 42*a*. The user activates the capsule by applying pressure to actuator tabs 91 and 92 as desired. In this case, as shown in FIG. 7, actuator 91 is selectively activated. As a result of downward force on actuator tab 91, plunger 93 which is engaged with actuator tab 91, pivots toward divider 40 until the distal end of the plunger 93 breaks at least a portion of seal 38. The flexible actuator 32 is deformed between the top of the chamber 37 and the bottom of the actuator tab 91. In some embodiments, the distal end of plunger 93 is pointed in order to provide a relatively sharp cutting or piercing edge which is suitable for breaking at least a portion of seal 38. Once at least a portion of seal 38 is broken, the first ingredient 41*a* will dispense from sub-chamber 41 into container 6. As mentioned previously, seal 38 may be separated by one or more lines of weakening such that a portion of the seal 38 will remain intact. For example, in FIG. 14, the portion of seal 38 covering sub-chamber 42 remains intact even though the portion covering sub-chamber 41 is broken by plunger 93. As a result of this configuration, the user can selectively dispense the first and second ingredients 41*a* and 42*a* from the sub-chambers 41 and 42 on demand as desired.

Figure 15:
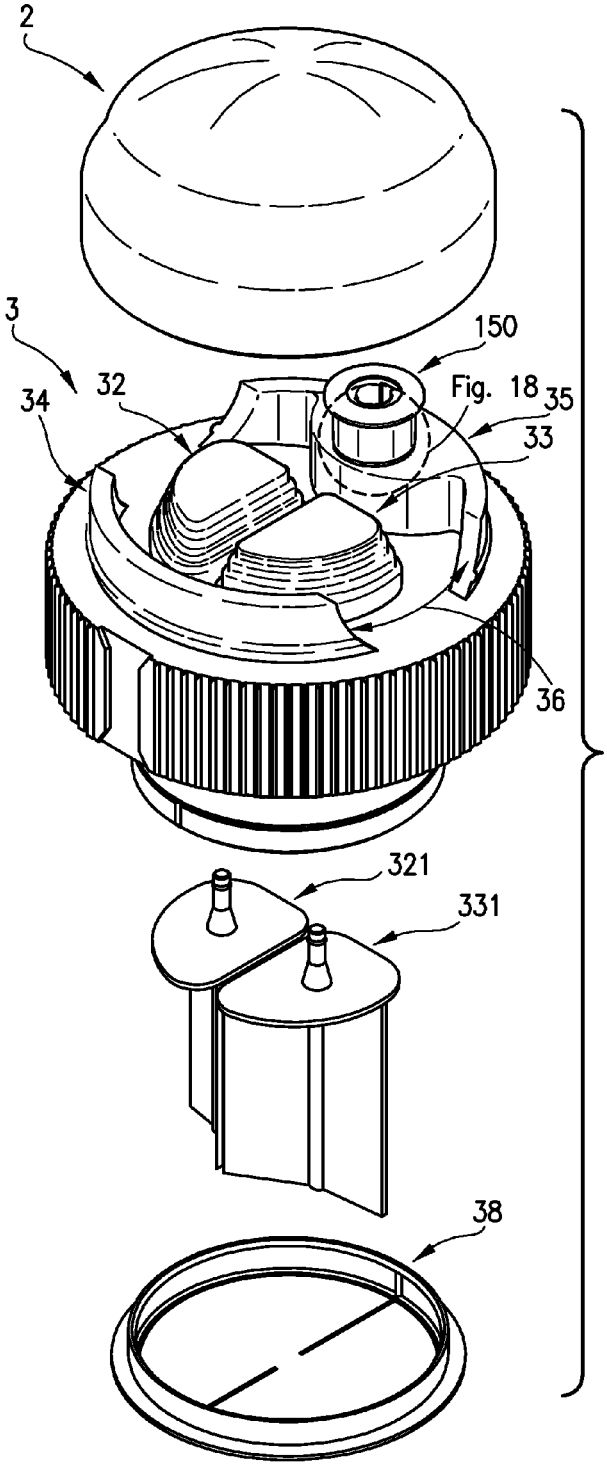
FIG. 15 is an exploded view of another embodiment of the dispensing capsule of the present invention.
Figure 16:
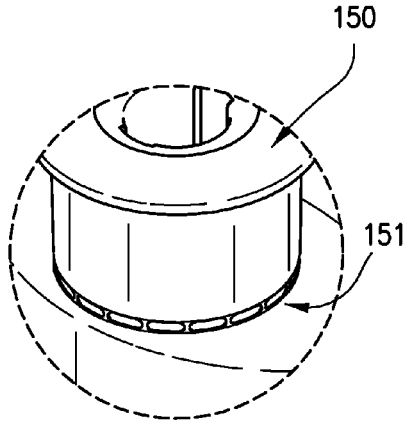
FIG. 16 is an up-close view of the spout included in one embodiment of the dispensing capsule of the present invention shown in FIG. 15.
Figure 17:
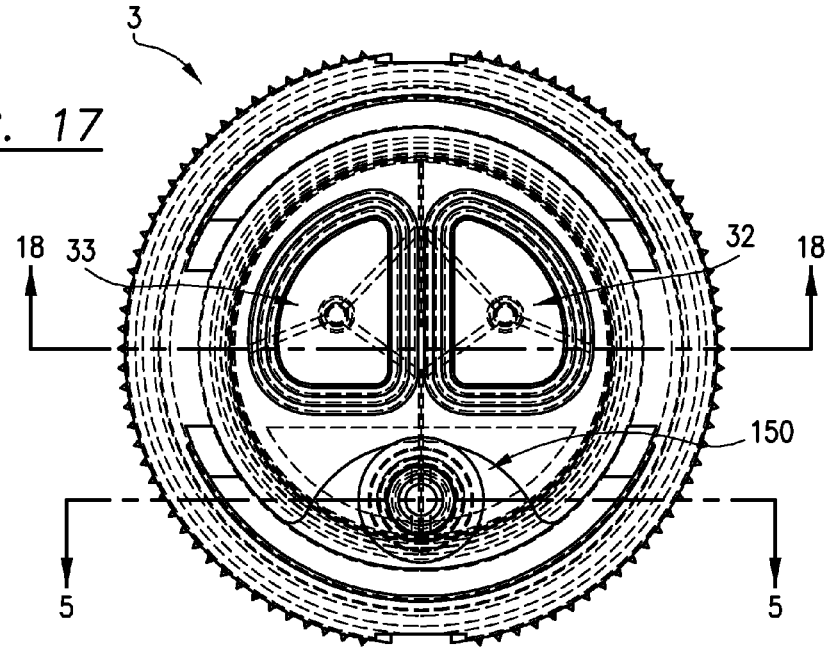
FIG. 17 is a top view of one embodiment of the dispensing capsule of the present invention shown in FIG. 15.
Figure 18:
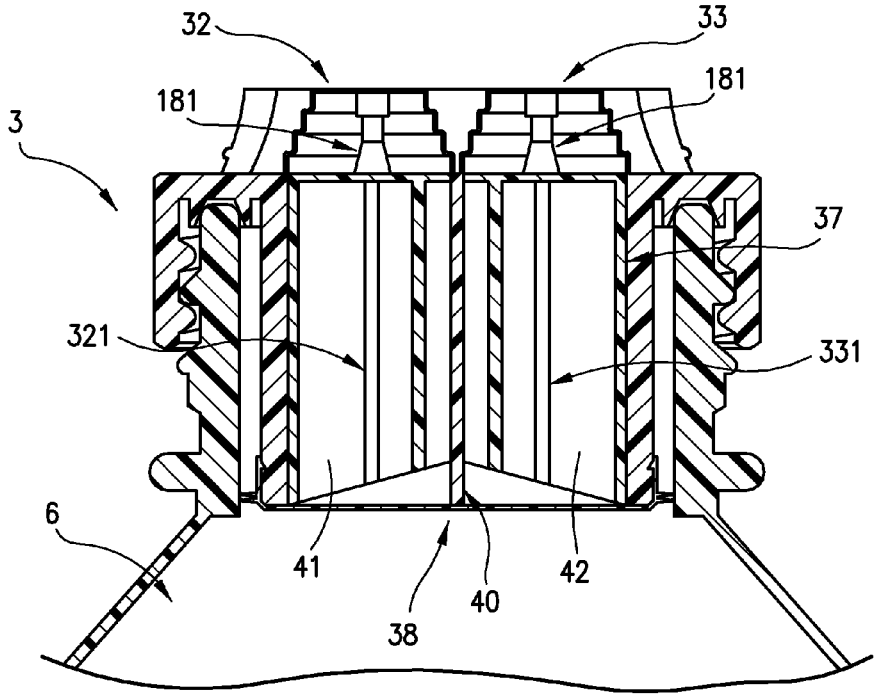
FIG. 18 is a section view of one embodiment of the dispensing capsule of the present invention shown in FIG. 15.

FIGS. 15 and 16 shown another embodiment of the present invention configured to have a liquid flow spout 150 to allow a dispensed mixture to flow back out of the capsule 1 without needed to remove it from the container to which it is attached. This configurations includes flexible actuators 32 and 33 adjacent to flow spout 150, which spout may be integrated into rim 35. In some embodiments, as shown in FIG. 16, flow spout 150 may have a breakable seal 151 which keeps the spout closed until the seal is manually broken, improve the safety and cleanliness of the device. The actuators 32 and 33 are engaged with tri-winged plungers 321 and 331, respectively. Turning to FIGS. 17 and 18, plungers 321 and 331 are disposed in their respective sub-chambers 41 and 42 whereby divider 40 bifurcates chamber 37. The actuators 32 and 33 are engaged to plungers 321 and 331 by way of projections 180 and 181 which extend from the top surfaces of the plungers. The projections provide a means to support and stabilize the relatively flexible actuators 32 and 33. The angle-cut plungers 321 and 331 are adapted to selectively break the seal 38, or a portion thereof, in order to dispense ingredients contained in their respective sub-chambers.

Figure 19:
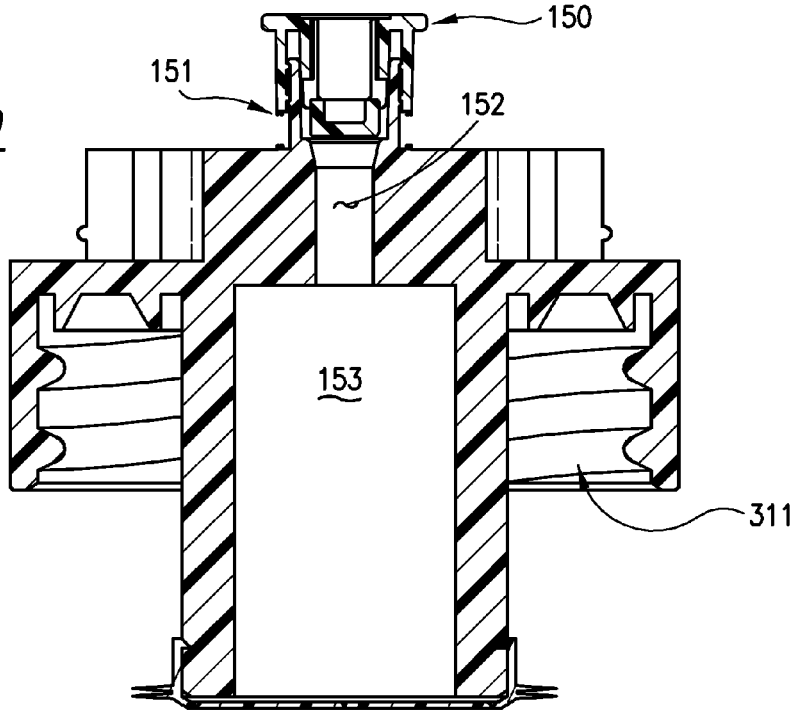
FIG. 19 is another section view of one embodiment of the dispensing capsule of the present invention shown in FIG. 15.
Figure 20:
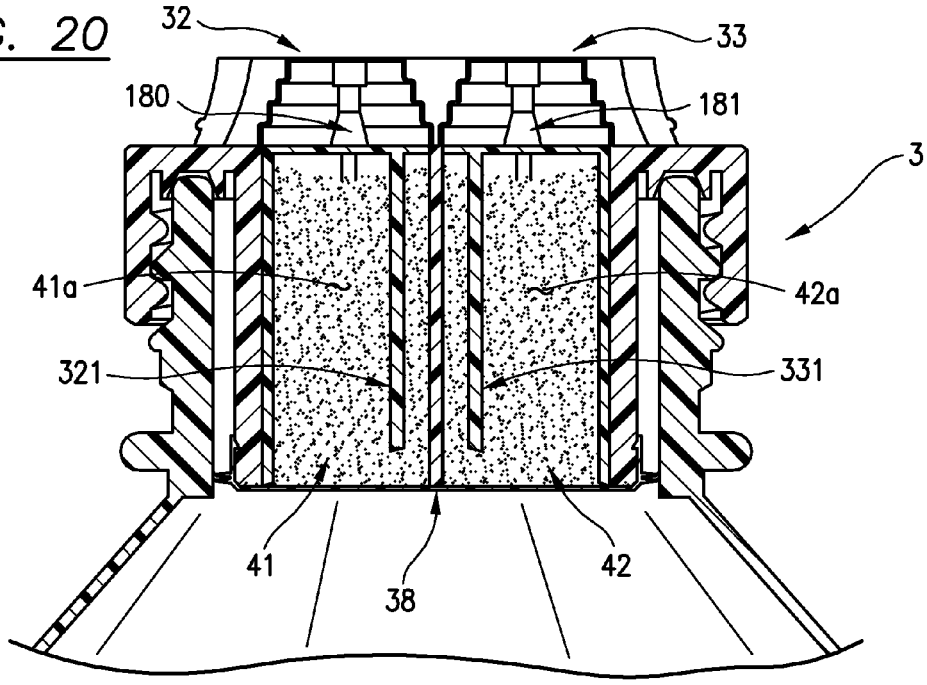
FIG. 20 is another section view of one embodiment of the dispensing capsule of the present invention shown in FIG. 15.
Figure 21:
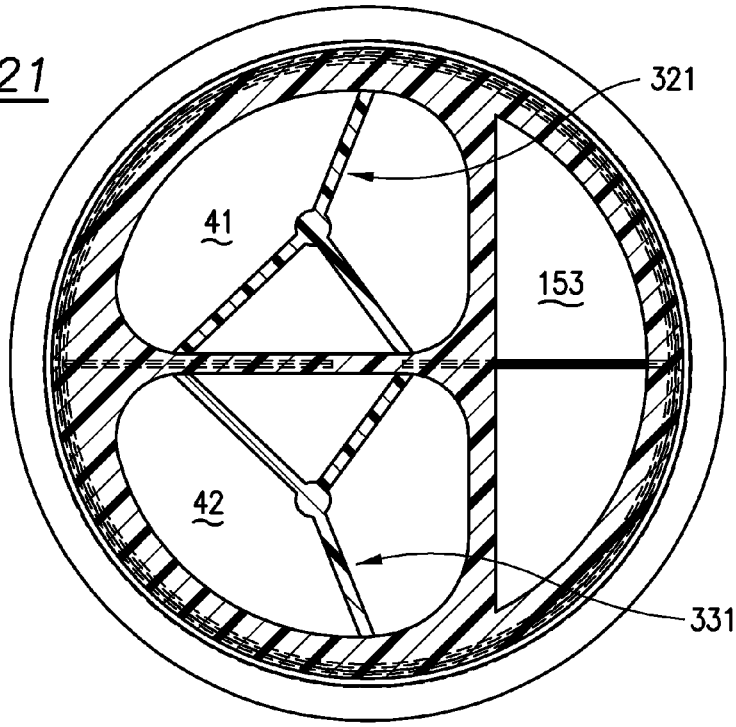
FIG. 21 is a bottom view of one embodiment of the dispensing capsule of the present invention shown in FIG. 15.
Figure 22:
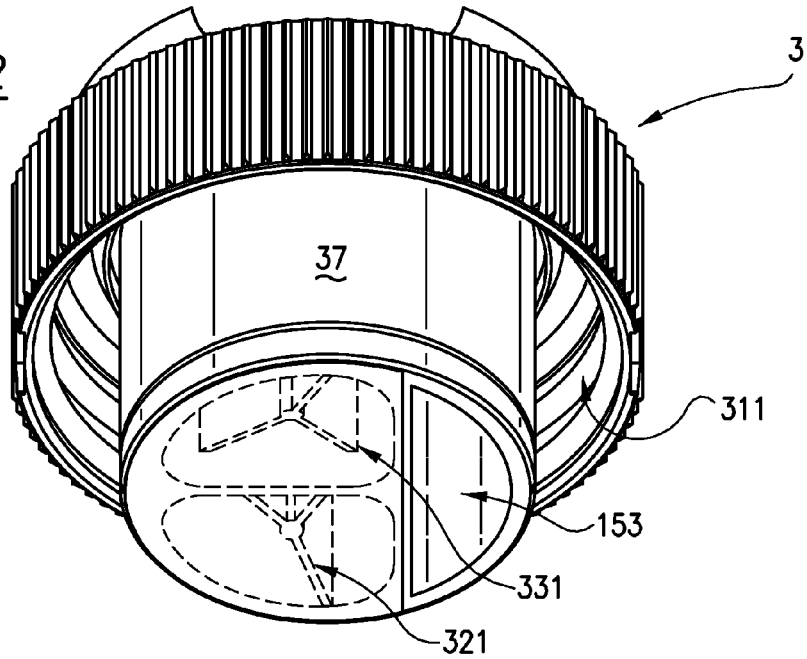
FIG. 22 is a bottom perspective view of one embodiment of the dispensing capsule of the present invention shown in FIG. 15.

FIG. 19 shows the opposite side of the capsule 1 whereby spout 150 is in flow communication with a conduit 152 and a drink-through chamber 153. Drink-through chamber 153 is in flow communication with the container 6 such that, after the first and second ingredients are selectively dispensed into the container 6, the user can access the mixture through spout 150 by way of chamber 153 and conduit 152. In some embodiments, the spout 150 is a re-sealable push-in/pull-out type spout found in the art. FIG. 20 demonstrates the plunger configuration, whereby the sub-chambers 41 and 42 are filled with a first and second ingredient 41*a* and 42*a*, respectively. FIGS. 21 and 22 demonstrate the underside of the capsule in this configuration, whereby the tri-winged 321 and 331 are disposed in sub-chambers 41 and 42 respectively and are both adjacent to the drink-through chamber 153. Seal 38 may be configured to cover only the sub-chambers 41 and 42, leaving drink-though chamber 153 open for later access to the mixture of ingredients obtained from container 6.

Figure 23:
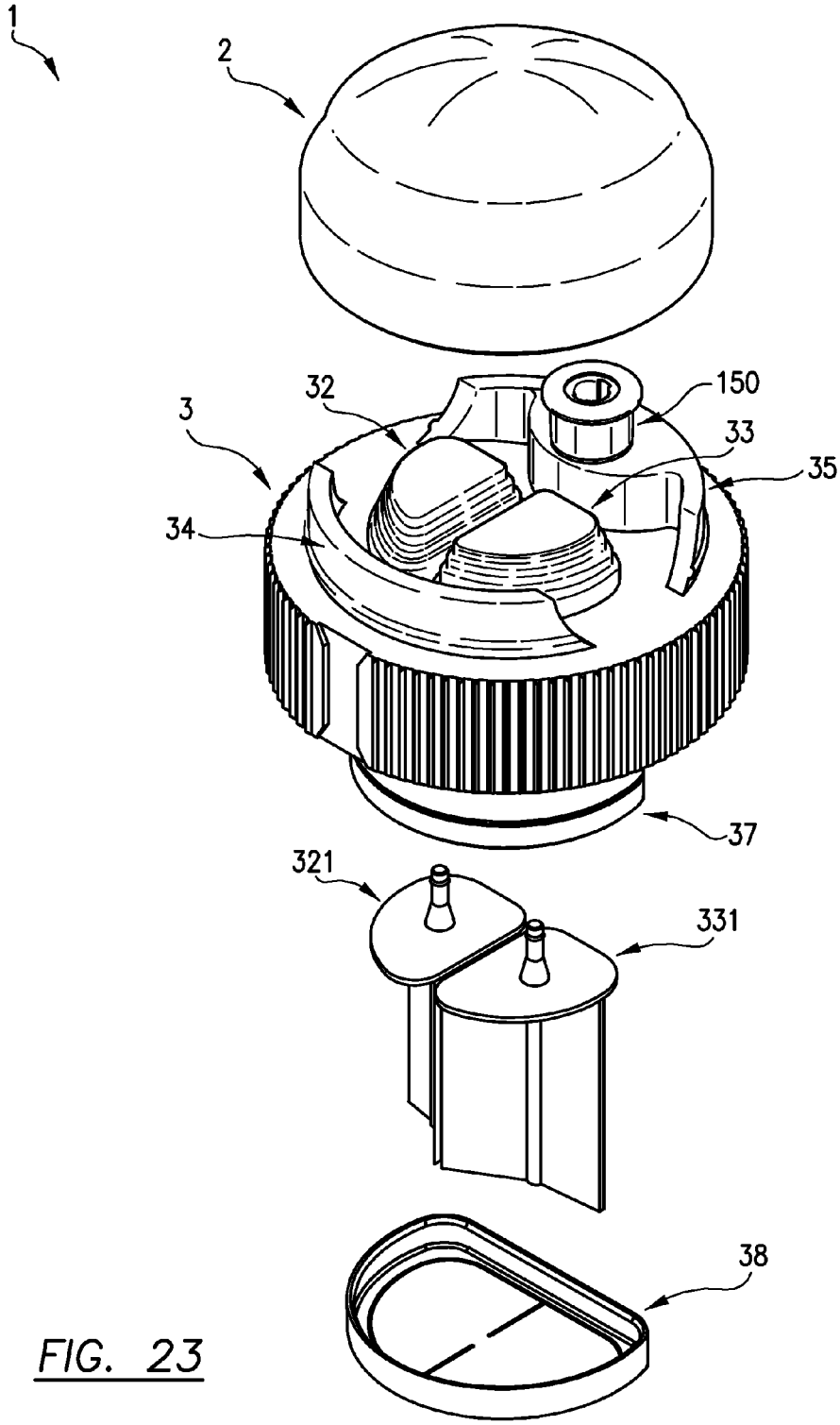
FIG. 23 is an exploded view of yet another embodiment of the dispensing capsule of the present invention.
Figure 24:
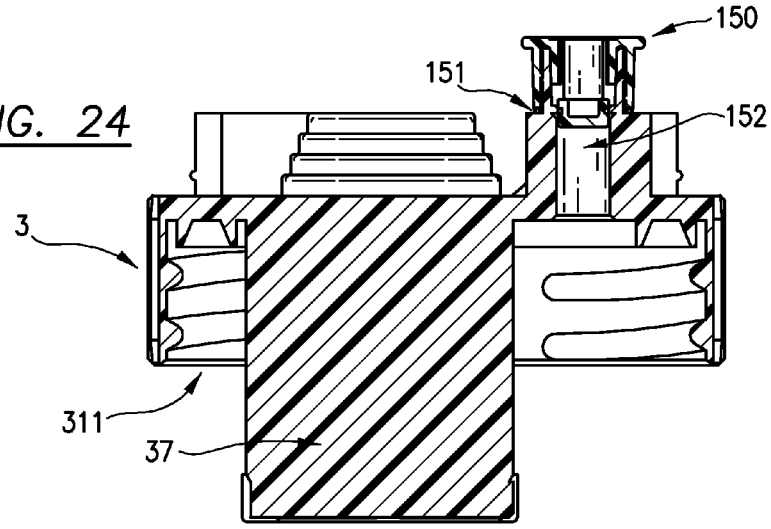
FIG. 24 is a section view of one embodiment of the dispensing capsule of the present invention shown in FIG. 23.
Figure 25:
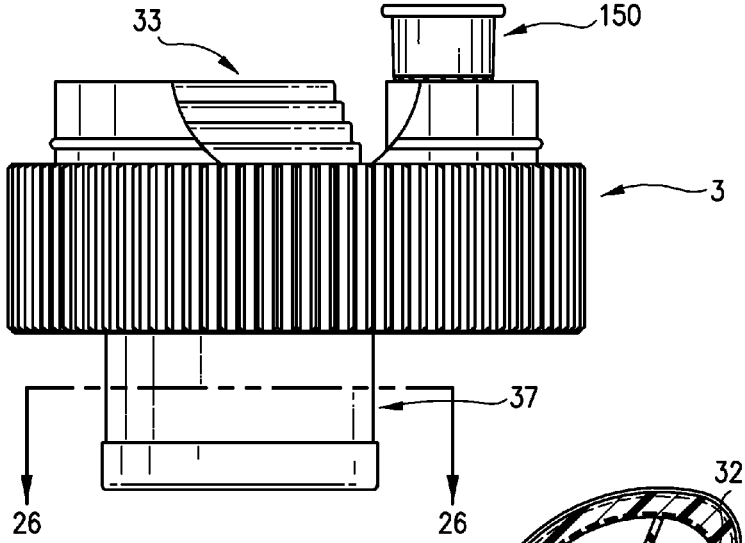
FIG. 25 is a side view of one embodiment of the dispensing capsule of the present invention shown in FIG. 23.
Figure 26:
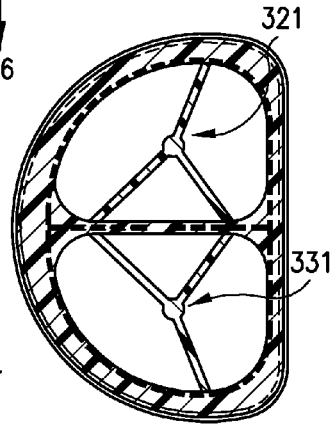
FIG. 26 is a bottom view of one embodiment of the dispensing capsule of the present invention shown in FIG. 23.

FIG. 23 is yet another embodiment of the capsule 1 of the present invention, similar to the embodiment shown in FIGS. 15-22. Shown is dust cover 2, cap body 3, and seal 38. Flexible actuators 32 and 33 are provided and are engaged with tri-winged plungers 321 and 331. Spout 150 is adjacent to actuators 32 and 33 to allow for access to the contents of a container 6 to which the capsule is attached. In this embodiment, the chamber 37 of cap body 3 is semi-circular or oblong such that it only extends downward to enclose the plungers 321 and 331. In contrast to the embodiment shown in FIGS. 15-22, this embodiment does not include a separate chamber for the spout 150. Seal 38 is correspondingly semi-circular or oblong to cover the like-shaped chamber 37. FIGS. 24-26 demonstrate this configuration in more detail. As shown, spout 150 is not in flow communication with a chamber but rather is "open" with respect to container 6 (not shown) such that any mixture in container 6 flows directly through cap body 3 and through spout 150 via conduit 152. This configuration assures that all of the mixture in container 6 can be accessed through the spout 150 and reduces the amount of mixture caught between the chamber 37 and the container 6.

Figure 27:
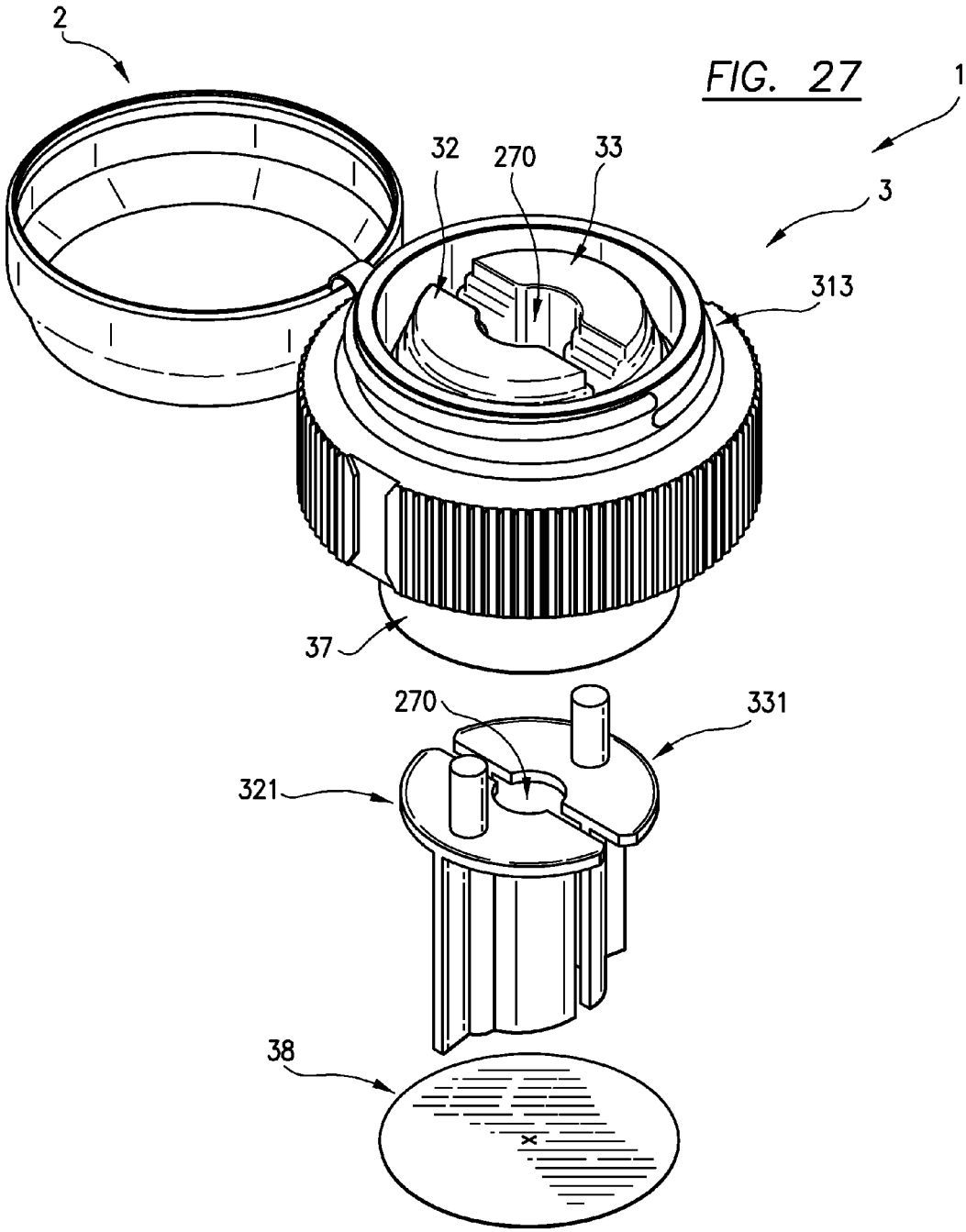
FIG. 27 is an exploded view of yet another embodiment of the dispensing capsule of the present invention.

FIG. 27 is yet another embodiment of capsule 1 in accordance with the present invention. Here, dust cover 2 is hingeably attached to cap body 3. Flexible actuators 32 and 33 are provided in circumferential fashion such that a channel 270 is delimited between the two. Likewise, the plungers 321 and 331 are circumferential oriented such that the channel 270 extends into chamber 37. A threaded rim 313 is provided around the actuators 32 and 33 and may be configured to engage an accessory item such as a sprayer or other applicator.

Figure 28:
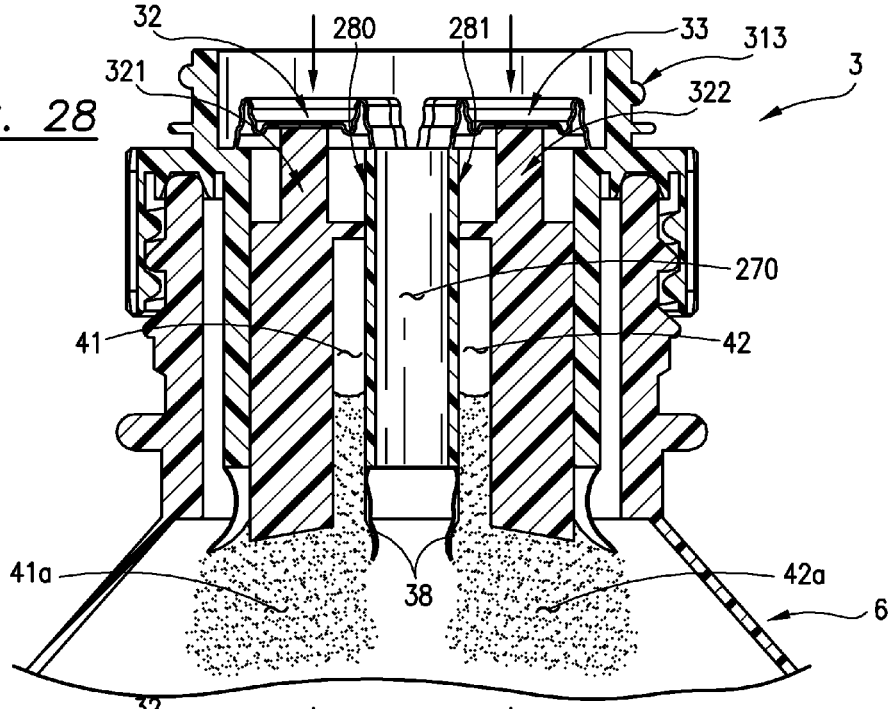
FIG. 28 is a section view of one embodiment of the dispensing capsule of the present invention shown in FIG. 27.
Figure 29:
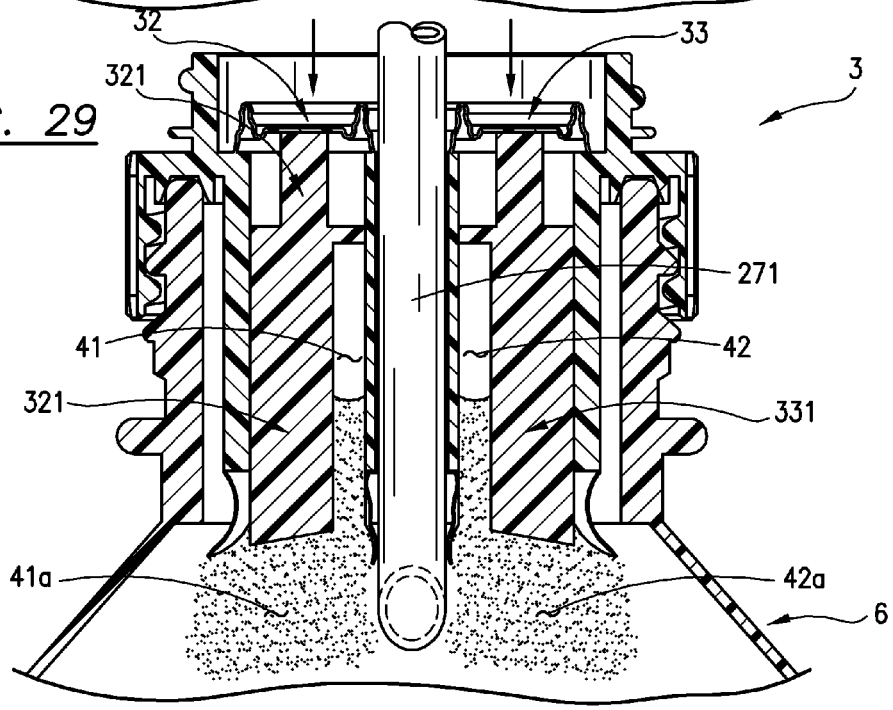
FIG. 29 is another section view of one embodiment of the dispensing capsule of the present invention shown in FIG. 27.

With reference to FIGS. 28 and 29, shown is this configuration in more detail. The plungers 321 and 331 are configured such that they separate chamber 37 into two sub-chambers 41 and 42. This separation is provided by the inner facing walls 280 and 281 of the plungers 321 and 331, respectively, whereby the sub-chambers 41 and 42 and delimited between the outside of primary chamber 37 and the inner facing walls 280 and 281, respectively. Each of the sub-chambers 41 and 42 contain a first and second ingredient 41*a* and 42*a*, respectively. The cap body 3 is threadingly engaged with a container 6. Pressure is applied to actuators 32 and/or 33 as desired, which causes their respective plungers to translate downward and pierce at least a portion of seal 38. In some embodiments, two seals 38 are provided, one for each of the chambers 41 and 42. Channel 270 is configured to receive a tubular straw or drinking straw 271 whereby the straw extends downward into container 6. Accordingly, when the contents of chamber 41 and/or 42 are dispensed, the user can access the resultant mixture in container 6 via channel 270 and straw 271.

Figure 30:
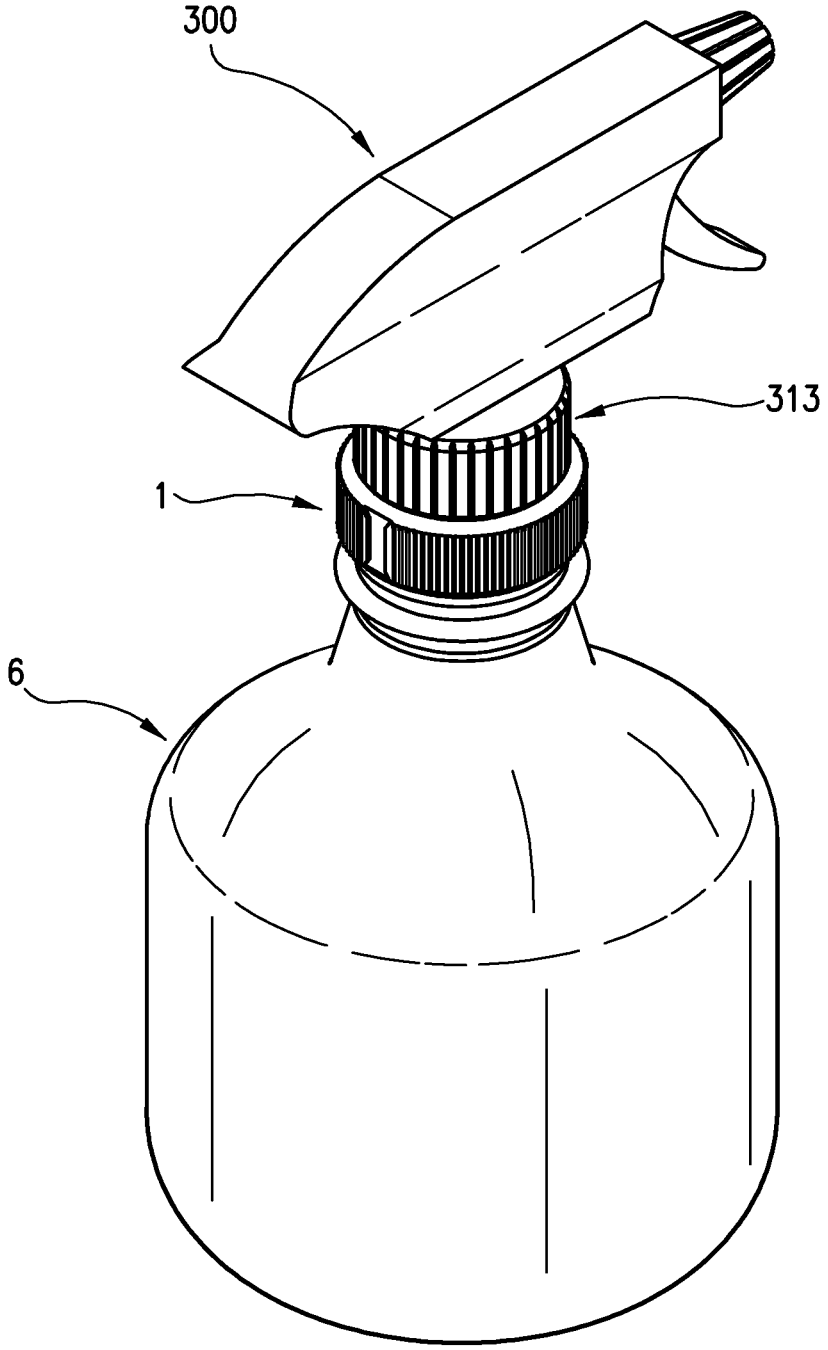
FIG. 30 is a perspective view of one embodiment of the dispensing capsule of the present invention shown in FIG. 27 with an accessory sprayer.

With reference to FIG. 30, shown is the capsule 1 of the present invention in flow communication with a sprayer 300. As shown, capsule 1 is disposed between container 6 and sprayer 300. The threads 311 toward the bottom of capsule 1 are engaged with the container 6 and the threaded rim 313 is engaged with the sprayer 300. In some embodiments, the capsule is first actuated via actuators 32 and 33, dispensing the first and/or second ingredients into container 6. Then the sprayer 300 is threaded onto threaded rim 313 with a straw 271 extending from the sprayer 300 through channel 270 and into container 6. Thus, the mixture in container 6 may be accessed without needed to remove the dispensing capsule 1 therefrom. Other accessories and applicators may also be attached to threaded rim 313 in like fashion.

Figure 31:
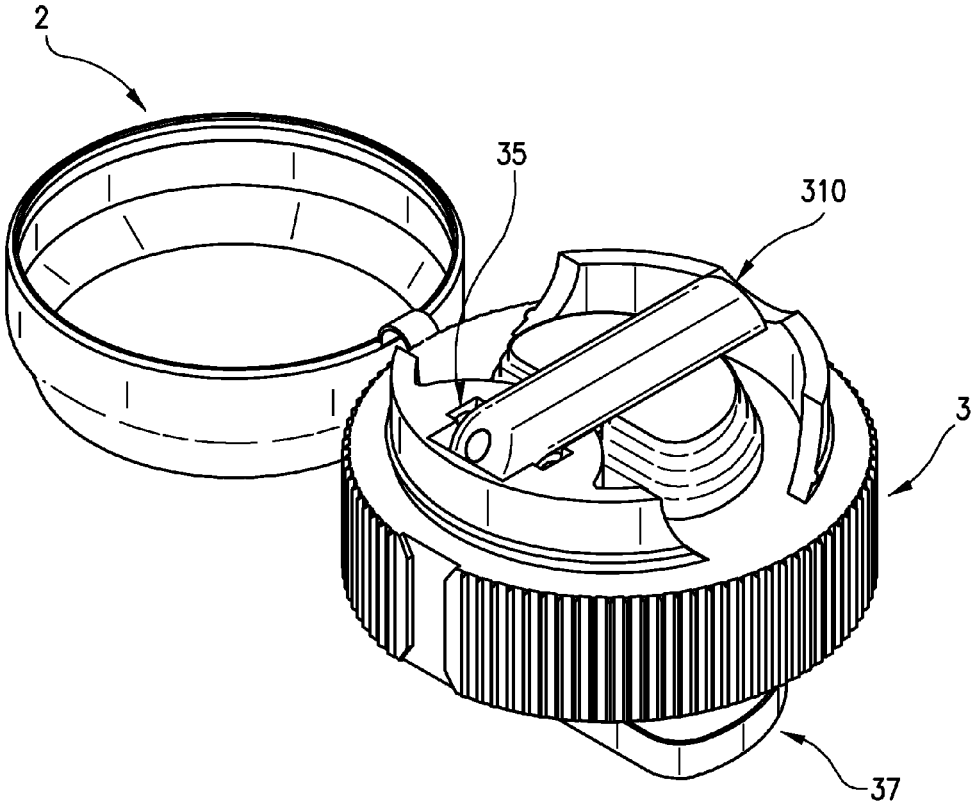
FIG. 31 is a perspective view of one embodiment of the dispensing capsule of the present invention shown with a hinged straw feature.

With reference to FIG. 31, shown is another embodiment of the present invention whereby spout 150 is substitute for a hingeable straw 310 that is attached to rim 35. This provides an alternative means for accessing the contents of a container 6 in accordance with the various embodiments of the present invention.

It is appreciated that the capsule of the present invention can comprise any combination of materials including plastics, rubbers, aluminum, resins, and the like. The capsule 1 may also be sized and shaped to accommodate fitment on any desired container such as bottles, IV bags, pouches, and the like. Furthermore, the threaded engagement with the container may be substitute for various snap-on or other releasable fitments known in the art.

It is further appreciated that the sealing member 38 may comprise a variety of plastic and foil-like materials. In some embodiments, the sealing member 38 comprises a thin plastic or resin material having one or more lines of weakening to allow for selective dispensing of the sub-chambers. In other embodiments, the sealing member 38 may comprise a foil or paper material equally suitable to be broken by the plunger action described above.

Yet still, it is appreciated that the capsule 1 of the present invention is not limited to having only two actuators and two plungers. Rather, the primary chamber 37 may be sub-divided to receive any number of plungers as desired and as feasible for a given application. Accordingly, the capsule may include a plurality of plungers received in a plurality of sub-chambers, each sub-chamber containing an ingredient to be dispensed. Furthermore, any number of corresponding actuators can be employed and, in some cases, the number of actuators need not match the number of plungers or sub-chambers. For example, as described above, a single flexible actuator may be engaged with two plungers and still provide independent actuation of the two plungers by pressing on either side of the actuator or it may provide simultaneous actuation by pressing more toward the middle of the actuator such that both plungers receive downward force at substantially the same time. Other configurations of actuators and plungers may be employed as desired.

Each of the sub-chambers can contain any liquid, powder and or gasses and or micro/nano encapsulation in any combination desired. The dispensing capsule can be mounted or applied at any location of a container including a bottle, pouch, can, IV bag, drum or tote. In some embodiments, the capsule is suited to be received on the threaded opening of such containers in order to provide a leak-free fitment. The chamber of the dispensing capsule stores any desired ingredient and may be dimensioned as desired to fit a variety of applications. The size and shape of the capsule of the present invention should not be construed as limited to the sizes and shapes shown in the drawings herein. Rather, the volume of the chamber and the diameter of the various components can vary as desired and/or can vary depending on the size and shape of the intended container or other parameters. Further, the chamber need not be filled completely, but rather can accept any volume of an ingredient desired depending on mixing parameters and the desired final product.

By way of example only, the device can be used for drinks, hair care, pet products, drugs, over the counter medications, cleaning products, soups, dressings, nitrogen, fuels and engine cleansing, oils, waxes, pH enhancers, oral care, oxygen, adhesives and other categories of use depending on the ingredients and formulas. Also a coating of any type of moisture absorbent can be applied to the inside of the chamber or sub-chambers to act as a desiccant and allow for moisture absorption of any excess moisture that may be contained inside the invention when filled and sealed.

This dispensing capsule can be molded in one or two pieces thus eliminating a high cost to manufacture other dispensing caps that are multiple pieces and difficult to fill and seal the ingredients desired. Furthermore, due to the encapsulated capsule excluding the sealing area the invention allows the ingredients to remain moisture free and have an unusually long shelf life and allowing with the sealed chamber to combine liquids and powders and oils and other ingredients to be sealed and stored separately if desired to prevent any reaction with one another. Also the device can include multiple applicators such as drinking spouts, pouring spouts and removable dosing cap for use of a product with one or more multiple chambers and plungers that have flow through to allow dispersing of all ingredients into a desired container. The exact configuration of such spouts and applications is not limited only to those designs shown in figures herein.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A dispensing capsule, threadably attachable to the neck of a primary container, said capsule including two independent ingredient chambers, such that two separate ingredients can be dispensed into said primary container at the time of use comprising:

a cap body including a first portion having an annular threaded wall for threadably attaching the cap body to a primary container, said cap body including first and second independent ingredient chambers, each of said chambers including and sealed by a sealing member;

first and second hollow plungers, each plunger received in a sub-chamber of each of said first and second chambers;

said first and second chambers having each a frangible sealable barrier for retaining an ingredient within each of said first and second chambers;

said first and second plungers each having a piercing member at one end for piercing said frangible sealable barrier for dispensing the ingredient contained in first and second said chambers and in said hollow first and second plungers; and one non-rotating flexible actuator sealably attached to the top of said cap body first and second chambers and engaged to each of said first and second plungers, said actuator accessible at a top portion of said cap body and sealably covering said plungers;

wherein upon selective application of pressure to said actuator, at least one of said two plungers displaces downward and breaks at least a portion of said sealing member in said first and second chamber.

2. The dispensing capsule of claim 1, wherein each of said sub-chambers are configured to store an ingredient.

3. The dispensing capsule of claim 1, wherein said cap body is adapted to be received on a container.

4. The dispensing capsule of claim 3, wherein said cap body includes internal threads such that said cap body is threadingly engaged with said container.

5. The dispensing capsule of claim 1, wherein said sealing member includes at least one line of weakening.

6. The dispensing capsule of claim 1, wherein said sealing member comprises foil.

7. The dispensing capsule of claim 1, wherein said one or more plungers includes an angle-cut distal tip adapted to break at least a portion of said sealing member.

8. The dispensing capsule of claim 1, wherein said flexible actuator comprises a bellow-type actuator.

* * * * *